US007598920B2

(12) United States Patent
Nagano

(10) Patent No.: US 7,598,920 B2
(45) Date of Patent: Oct. 6, 2009

(54) INPUT DEVICE OF TWO ORTHOGONAL POLARIZED-WAVE WAVEGUIDE TYPE, AND RADIO WAVE RECEIVING CONVERTER AND ANTENNA DEVICE USING THE INPUT DEVICE

(75) Inventor: Atsushi Nagano, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 11/967,682

(22) Filed: Dec. 31, 2007

(65) Prior Publication Data

US 2008/0204348 A1 Aug. 28, 2008

(30) Foreign Application Priority Data

Feb. 28, 2007 (JP) ..... 2007-048296

(51) Int. Cl.
*H01Q 13/00* (2006.01)

(52) U.S. Cl. ..... 343/786; 343/756; 333/21 A

(58) Field of Classification Search ..... 343/756, 343/772–786; 333/21 A, 21 R
See application file for complete search history.

(56) References Cited

U.S. PATENT DOCUMENTS 6,018,276 A * 1/2000 Hirota et al. ..... 333/26

FOREIGN PATENT DOCUMENTS

| | | | |
|---|---|---|---|
| JP | 3169117 | | 7/1991 |
| JP | 4-328901 | A | 11/1992 |
| JP | 4329701 | | 11/1992 |
| JP | 05-018102 | | 3/1993 |
| JP | 7-263903 | A | 10/1995 |
| JP | 9036605 | | 2/1997 |
| JP | 10-261902 | A | 9/1998 |
| JP | 11041001 | | 2/1999 |
| JP | 11274847 | | 10/1999 |
| JP | 2001223501 | | 8/2001 |
| JP | 2004040405 | | 2/2004 |

* cited by examiner

*Primary Examiner*—James H. Cho
*Assistant Examiner*—Jany Tran
(74) *Attorney, Agent, or Firm*—Birch, Stewart, Kolasch & Birch, LLP

(57) ABSTRACT

A radio wave receiving converter is provided with a circular waveguide unit to which a vertically-polarized wave and a horizontally-polarized wave are input, first and second board holding units provided on the upside and the downside of the circular waveguide unit and holding first and second circuit boards, respectively, and first and second feed probes having tip portions provided to protrude into a waveguide element in parallel with the vertically-polarized wave and the horizontally-polarized wave, respectively, and having proximal end portions connected to the first and second circuit boards, respectively. Accordingly, the first and second board holding units are provided on the upside and the downside of the circular waveguide unit, and thus there is no need to use a sliding insert in the design of a die, so that the die can easily be fabricated at low cost.

11 Claims, 7 Drawing Sheets

INPUT DEVICE OF TWO ORTHOGONAL POLARIZED-WAVE WAVEGUIDE TYPE, AND RADIO WAVE RECEIVING CONVERTER AND ANTENNA DEVICE USING THE INPUT DEVICE

This nonprovisional application is based on Japanese Patent Application No. 2007-048296 filed with the Japan Patent Office on Feb. 28, 2007, the entire contents of which are hereby incorporated by reference.

BACKGROUND OF THE INVENTION

1. Field of the Invention

The present invention relates to an input device of a two orthogonal polarized-wave waveguide type, and a radio wave receiving converter and an antenna device using the input device, and particularly relates to an input device of a two orthogonal polarized-wave waveguide type, mainly used in a radio wave feeder unit of a receiving converter that is mounted on a satellite reception parabolic antenna.

2. Description of the Background Art

FIG. 9 is a cross-sectional view showing a configuration of a conventional radio wave receiving converter. FIG. 10 is a cross-sectional view taken along a line X-X in FIG. 9, while FIG. 11 is a cross-sectional view taken along a line XI-XI in FIG. 9. In FIGS. 9-11, the radio wave receiving converter is provided with a chassis 51 integrally formed by die-casting that mainly uses aluminum, zinc, and others.

Chassis 51 includes a circular waveguide unit 52, a horn unit 53, a board holding unit 54, and a terminal holding unit 55. Circular waveguide unit 52 has a waveguide element 52*a* having a circular cross-sectional shape and a prescribed length. A rear end of waveguide element 52*a* is closed by a reflection wall 52*b*.

Circular waveguide unit 52 is provided with two feed probes 60 and 61 for receiving a vertically-polarized wave V and a horizontally-polarized wave H, respectively, and a reflection rod 62 for reflecting vertically-polarized wave V. Tip portions of feed probes 60 and 61 protrude into waveguide element 52*a* from an inner peripheral wall of circular waveguide unit 52 in directions parallel with polarized waves V and H, respectively. Reflection rod 62 is provided to penetrate waveguide element 52*a* in the direction parallel with polarized wave V.

A proximal end portion of feed probe 60 is fixed to a through hole formed on an upside of waveguide element 52*a* with an insulating member interposed therebetween, and protrudes from an upper surface of circular waveguide unit 52. Feed probe 61 is bent at a right angle, and its proximal end portion is fixed to a through hole formed on the upside of waveguide element 52*a* with an insulating member interposed therebetween, and protrudes from the upper surface of circular waveguide unit 52.

Horn unit 53 is provided at an opening of circular waveguide unit 52 and introduces polarized waves V and H into circular waveguide unit 52. Board holding unit 54 is formed into a tray-like shape having a rectangular rim 54*a*, and has one end portion provided on circular waveguide unit 52, and the other end portion protruding rearward from circular waveguide unit 52. Board holding unit 54 accommodates a circuit board 63 with a ground plane facing downward. Each of the proximal end portions of feed probes 60 and 61 penetrates a hole in circuit board 63, and is connected by soldering, for example, to a circuit provided at a surface of circuit board 63.

Terminal holding unit 55 is provided on a downside of the other end portion of board holding unit 54. Terminal holding unit 55 has an output terminal 64 fixed thereto. Output terminal 64 is connected to circuit board 63 via a line introduced into a through hole formed in board holding unit 54. Circuit board 63 has a conversion circuit mounted thereon for amplifying and frequency-converting polarized waves V and H received at feed probes 60 and 61. An output signal of the conversion circuit is provided to a television tuner via output terminal 64.

A lid-like metal frame 65 is provided to cover an inside of rim 54*a* of board holding unit 54. Metal frame 65 has a rim and a septum 65*a* both of which are brought into contact with a ground plane provided at the surface of circuit board 63, and has an end portion fixed to a bottom surface of board holding unit 54 with a plurality of screws 66. This allows circuit board 63 and metal frame 65 to be fixed to chassis 51, and the circuit provided at the surface of circuit board 63 to be shielded by metal frame 65. Furthermore, septum 65*a* of metal frame 65 prevents each of the received polarized waves from leaking to a circuit intended for another polarized wave.

An operation of the radio wave receiving converter will hereinafter be described. Polarized waves V and H, which are collected at horn unit 53, propagate through waveguide element 52*a* in circular waveguide unit 52, and are reflected at reflection rod 62 and reflection wall 52*b*, respectively. Vertically-polarized wave V reflected at reflection rod 62 is received by feed probe 60, transmitted to a microstrip line of circuit board 63, amplified and frequency-converted at a high-frequency circuit in a subsequent stage into an intermediate frequency signal, and transmitted to the tuner via output terminal 64. Horizontally-polarized wave H reflected at reflection wall 52*b* is received by feed probe 61, transmitted to a microstrip line of circuit board 63, amplified and frequency-converted at a high-frequency circuit in a subsequent stage into an intermediate frequency signal, and transmitted to the tuner via output terminal 64.

FIG. 12 is a cross-sectional view showing a configuration of another conventional radio wave receiving converter, and is to be compared with FIG. 10. In FIG. 12, the radio wave receiving converter differs from the radio wave receiving converter in FIGS. 9-11 in that two circular waveguide units 52 are provided. Two circular waveguide units 52 are arranged in parallel at a prescribed spacing, and formed integrally. Each of circular waveguide units 52 is provided with feed probes 60 and 61. Board holding unit 54, circuit board 63, and metal frame 65 are provided in a manner common to two circular waveguide units 52. With this radio wave receiving converter, it is possible to receive vertically-polarized waves V1, V2 and horizontally-polarized waves H1, H2 transmitted from two adjacent satellites.

FIG. 13 is a cross-sectional view showing a substantial part of still another conventional radio wave receiving converter, and is to be compared with FIG. 10. Such a radio wave receiving converter is disclosed in, for example, Japanese Patent Laying-Open No. 10-261902. With reference to FIG. 13, this radio wave receiving converter differs from the radio wave receiving converter in FIGS. 9-11 in that a board holding unit 70, a circuit board 71, and a metal frame 72 are additionally provided. In the conversion circuit mounted on circuit board 63, a circuit portion exclusively used for receiving horizontally-polarized wave H is mounted on circuit board 71. Board holding unit 70 is provided vertically to board holding unit 54 so as to hold circuit board 71 in a direction vertical to horizontally-polarized wave H.

Board holding unit 70 is formed into a tray-like shape having a rectangular rim 70*a*, and provided on the left side of circular waveguide unit 52 in the drawing. Board holding unit 70 accommodates circuit board 71 with a ground plane facing the right side. Feed probe 61 is not bent, and its proximal end portion penetrates a hole in circuit board 71 and connected by soldering, for example, to a circuit provided at a surface of circuit board 71.

Lid-like metal frame 72 is provided to cover an inside of rim 70*a* of board holding unit 70. Metal frame 72 has a rim brought into contact with a ground plane provided at the surface of circuit board 71, and has an end portion fixed to a bottom surface of board holding unit 70 by a screw 73. This allows circuit board 71 and metal frame 72 to be fixed to chassis 51, and the circuit provided at the surface of circuit board 71 to be shielded by metal frame 72. Metal frames 65 and 72 prevent the received polarized waves from leaking to circuits intended for other polarized waves, respectively. An operation of the radio wave receiving converter is the same as that of the radio wave receiving converter shown in FIGS. 9-11, and hence the description thereof will not be repeated.

As described above, in the conventional radio wave receiving converter shown in FIGS. 9-12, a plurality of received polarized waves V and H are amplified and frequency-converted at the single circuit board 63, and each of the polarized waves is prevented from leaking to a circuit intended for another polarized wave, by bringing septum 65*a* of metal frame 65 into the ground plane of circuit board 63 and shielding the circuits.

However, chassis 51 and metal frame 65 are fabricated by die-casting, and hence they deform owing to variations in casting condition and the like. This causes a problem of nonuniform contact between septum 65*a* of metal frame 65 and the ground plane on circuit board 63 and thus deterioration in shielding effect, and leakage of each of the polarized waves to a circuit intended for another polarized wave and thus deterioration in cross polarization characteristic. This problem becomes prominent when a die-casting die wears, and hence the die requires frequent renewal, which entails enormous cost for the die.

In the radio wave receiving converter shown in FIG. 12, in particular, each of the polarized waves V1, V2, H1, and H2 must be shielded, and metal frame 65 inevitably grows in size. Accordingly, if metal frame 65 suffers the slightest deformation such as warpage, the polarized waves disadvantageously leak. Furthermore in recent years, reception from a plurality of satellites, a multi-output converter, and the like have often been adopted, so that signals are often switched at a switch circuit in a subsequent stage of the circuit. Mixture of a cross polarization characteristic and an isolation characteristic of the switch circuit affects the quality of the signals, and hence improvement in cross polarization characteristic on the periphery of a waveguide feeder unit is demanded.

In contrast, in the radio wave receiving converter in FIG. 13, circuit board 63 for receiving polarized wave V and circuit board 71 for receiving polarized wave H are separately provided, and accordingly a cross polarization characteristic is improved. However, bottom surfaces of board holding units 54 and 70 are orthogonal to each other, so that one of the bottom surfaces must be formed with a sliding insert in the design of a die. This causes a problem of complexity of the die, and hence cost increase.

SUMMARY OF THE INVENTION

Accordingly, a main object of the present invention is to provide an inexpensive input device of a two orthogonal polarized-wave waveguide type, having a favorable cross polarization characteristic, and a radio wave receiving converter and an antenna device that use the input device.

An input device of a two orthogonal polarized-wave waveguide type according to the present invention includes: a waveguide to which first and second polarized waves orthogonal to each other are input; first and second board holding units for holding first and second circuit boards, respectively; and first and second probes having tip portions provided to protrude in the waveguide in parallel with the first and second polarized waves, respectively, and having proximal end portions connected to the first and second circuit boards, respectively. The waveguide and the first and second board holding units are integrally formed. The first board holding unit is provided on one side of the waveguide, and the second board holding unit is provided on the other side of the waveguide, the other side of the waveguide being opposite to the first board holding unit.

Accordingly, the first circuit hoard for the first polarized wave and the second circuit board for the second polarized wave are separately provided, so that a preferable cross polarization characteristic can be obtained. Furthermore, the first and second board holding units are provided on the opposite sides of the waveguide, so that there is no need to use a sliding insert in the design of a die. It is therefore possible to fabricate the die at low cost, and lower the price of the radio wave receiving converter.

Preferably, the first probe is approximately vertically provided at the first circuit board. The second probe is bent at approximately a right angle, and a proximal end portion of the second probe is approximately vertically provided at the second circuit board.

Further preferably, two of the waveguides, one set of the first and second board holding units, and two sets of the first and second probes are provided. The two of the waveguides and the first and second board holding units are formed integrally. The two of the waveguides are arranged in parallel at a prescribed spacing. The first board holding unit is provided on one side of the two of the waveguides, and the second board holding unit is provided on the other side of the two of the waveguides, the other side of the two of the waveguides being opposite to the first board holding unit. A distance between two of the second probes is larger than a distance between two of the first probes.

Further preferably both of the first and second probes are bent at approximately 45 degrees, and the proximal end portions of the first and second probes are approximately vertically provided at the first and second circuit boards, respectively.

Further preferably, one end of the waveguide is opened for introducing the first and second polarized waves. The other end of the waveguide is closed by a reflection wall. A reflection rod reflecting the first polarized wave is provided in the waveguide in parallel with the first polarized wave. The first probe is provided on a side of the one end of the waveguide, with respect to the reflection rod. The second probe is provided between the reflection rod and the reflection wall. The first probe receives the first polarized wave reflected at the reflection rod. The second probe receives the second polarized wave reflected at the reflection wall.

Further preferably, the waveguide is a circular waveguide having a waveguide element with a circular cross-sectional shape.

Further preferably, the waveguide is a rectangular waveguide having a waveguide element with a rectangular cross-sectional shape.

Further preferably, a plurality of the waveguides, one set of the first and second board holding units, and a plurality of sets of the first and second probes are provided. The plurality of the waveguides and the one set of the first and second board holding units are integrally formed. The plurality of the waveguides are arranged in parallel at a prescribed spacing. The first board holding unit is provided on one side of the plurality of the waveguides, and the second board holding unit is provided on the other side of the plurality of the waveguides, the other side of the plurality of the waveguides being opposite to the first board holding unit.

Furthermore, a radio wave receiving converter according to the present invention includes: the above-described input device of the two orthogonal polarized-wave waveguide type; and the first and second circuit boards held by the first and second board holding units, respectively. A conversion circuit amplifying and frequency-converting the first and second polarized waves received at the first and second probes is arranged dividedly at the first and second circuit boards.

Furthermore, an antenna device according to the present invention includes: the above-described radio wave receiving converter; and a reflection unit receiving the first and second polarized waves transmitted from a satellite, and reflecting the first and second polarized waves to the waveguide.

The foregoing and other objects, features, aspects and advantages of the present invention will become more apparent from the following detailed description of the present invention when taken in conjunction with the accompanying drawings.

DETAILED DESCRIPTION OF THE INVENTION

First Embodiment

Figure 1:
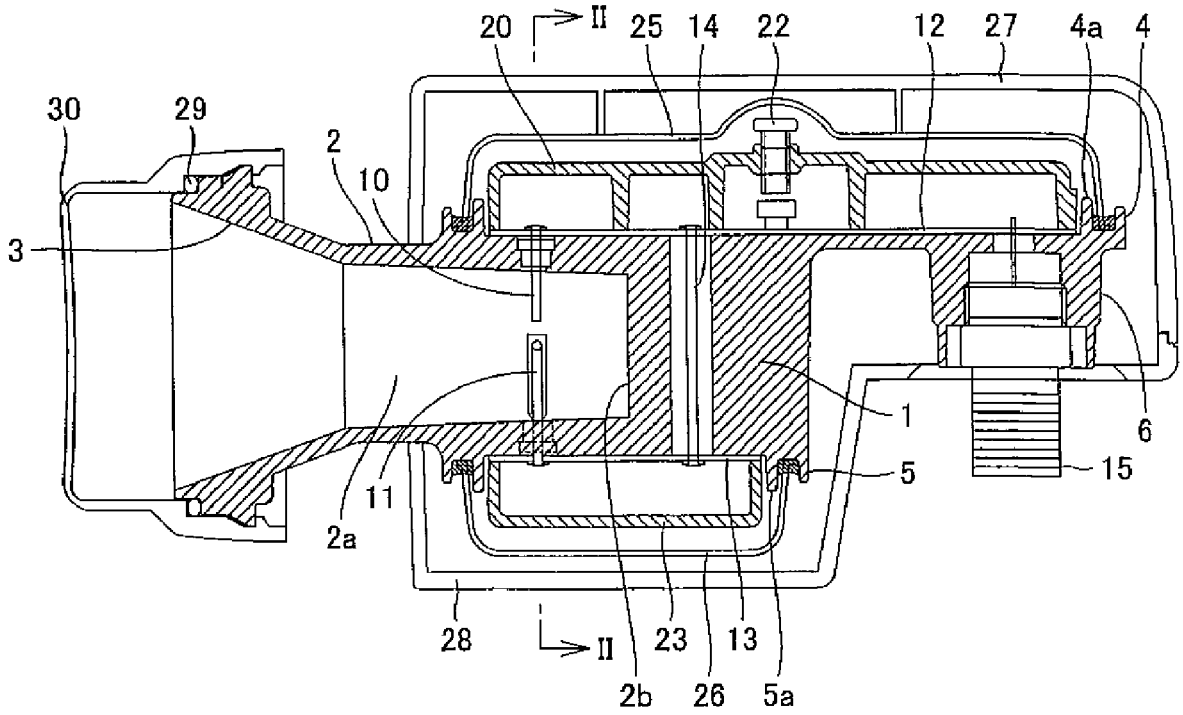
FIG. 1 is a cross-sectional view showing a configuration of a radio wave receiving converter according to a first embodiment of the present invention.
Figure 2:
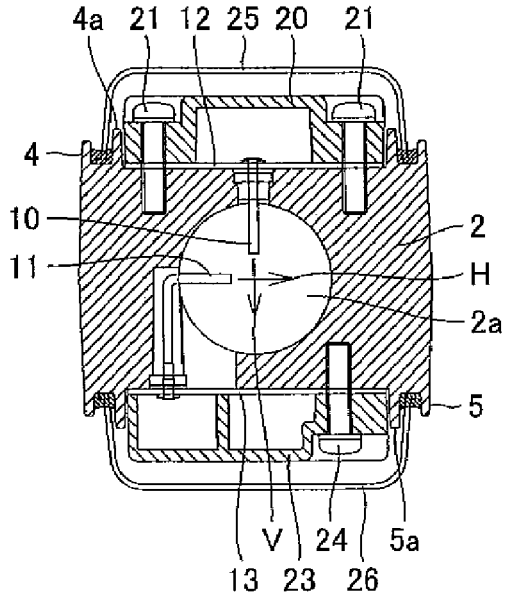
FIG. 2 is a cross-sectional view taken along a line II-II in FIG. 1.

FIG. 1 is a cross-sectional view showing a configuration of a radio wave receiving converter according to a first embodiment of the present invention, and FIG. 2 is a cross-sectional view taken along a line II-II in FIG. 1. In FIGS. 1 and 2, the radio wave receiving converter is provided with a chassis 1 integrally formed by die-casting that mainly uses aluminum, zinc, and others.

Chassis 1 includes a circular waveguide unit 2, a horn unit 3, board holding units 4 and 5, and a terminal holding unit 6. Circular waveguide unit 2 has a general shape in which a transverse hole having a circular cross-sectional shape and a prescribed length is formed in a rectangular parallelepiped metal block. The transverse hole constitutes a waveguide element 2*a*, and a rear end of waveguide element 2*a* is closed by a reflection wall 2*b*.

Circular waveguide unit 2 is provided with two feed probes 10 and 11 for receiving vertically-polarized wave V and horizontally-polarized wave H, respectively. Tip portions of feed probes 10 and 11 protrude into waveguide element 2*a* from an inner peripheral wall of circular waveguide unit 2, in positions apart from reflection wall 2*b* by a prescribed distance (approximately a quarter of wavelength $\lambda$ of polarized waves V and H) in directions parallel with polarized waves V and H, respectively.

A proximal end portion of feed probe 10 is fixed to a through hole formed on an upside of waveguide element 2*a* with an insulating member interposed therebetween, and protrudes from an upper surface of circular waveguide unit 2. Feed probe 11 is bent at a right angle, and its proximal end portion is fixed to a through hole formed on a downside of waveguide element 2*a* with an insulating member interposed therebetween, and protrudes from a lower surface of circular waveguide unit 2. Chassis 1 and feed probes 10 and 11 constitute an input device of a two orthogonal polarized-wave waveguide type.

Horn unit 3 is provided at an opening of circular waveguide unit 2 and introduces polarized waves V and H into circular waveguide unit 2. Board holding unit 4 is formed into a tray-like shape having a rectangular rim 4*a*, and has one end portion provided on circular waveguide unit 2, and the other end portion protruding rearward from circular waveguide unit 2. Board holding unit 4 accommodates a circuit board 12 with a ground plane facing downward. The proximal end portion of feed probe 10 penetrates a hole in circuit board 12, and is connected by soldering, for example, to a circuit provided at a surface of circuit board 12.

Board holding unit 5 is formed into a tray-like shape having a rectangular rim 5*a*, and provided under circular waveguide unit 2. Board holding unit 5 accommodates a circuit board 13 with a ground plane facing upward. A proximal end portion of feed probe 11 penetrates a hole in circuit board 13, and is connected by soldering, for example, to a circuit provided at a surface of circuit board 13. Circuit boards 12 and 13 are connected to each other by a connection probe 14 inserted into a through hole formed behind reflection wall 2*b* of circular waveguide unit 2.

Terminal holding unit 6 is provided on a downside of the other end portion of board holding unit 4. Terminal holding unit 6 has an output terminal 15 fixed thereto. Output terminal 15 is connected to circuit board 12 via a line inserted into a through hole formed in board holding unit 4. Circuit boards 12 and 13 have a conversion circuit mounted thereon in a divided manner, for amplifying and frequency-converting polarized waves V and H received at feed probes 10 and 11. An output signal of the conversion circuit is provided to a television tuner via output terminal 15.

A lid-like metal frame 20 is provided to cover an inside of rim 4*a* of board holding unit 4. Metal frame 20 has a rim and a septum both of which are brought into contact with a ground plane provided at the surface of circuit board 12, and has an end portion fixed to a bottom surface of board holding unit 4 by a plurality of screws 21. This allows circuit board 12 and metal frame 20 to be fixed to chassis 1, and the circuit provided at the surface of circuit board 12 to be shielded by metal frame 20. Note that metal frame 20 is also provided with a screw 22 for adjusting a constant of the circuit provided at the surface of circuit board 12.

Similarly, a lid-like metal frame 23 is provided to cover an inside of rim 5*a* of board holding unit 5. Metal frame 23 has a rim and a septum both of which are brought into contact with a ground plane provided at the surface of circuit board 13, and has an end portion fixed to a bottom surface of board holding unit 5 by a plurality of screws 24. This allows circuit board 13 and metal frame 23 to be fixed to chassis 1, and the circuit provided at the surface of circuit board 13 to be shielded by metal frame 23.

Furthermore, a plastic lid 25 is provided to cover metal frame 20. A rim of lid 25 is inserted into a groove that is formed in rim 4*a* of board holding unit 4 and filled with a liquid sealant. When the liquid sealant is cured, lid 25 renders circuit board 12 and others waterproof.

Similarly, a plastic lid 26 is provided to cover metal frame 23. A rim of lid 26 is inserted into a groove that is formed in rim 5*a* of board holding unit 5 and filled with a liquid sealant. When the liquid sealant is cured, lid 26 renders circuit board 13 and others waterproof.

Lids 25 and 26 and terminal holding unit 6 are further covered with decorative cabinets 27 and 28. Furthermore, the opening of horn unit 3 has an O-ring 29 fitted thereinto, and has a waterproof cap 30 provided thereon, so as to prevent rainwater and the like from entering circular waveguide unit 2.

An operation of the radio wave receiving converter will hereinafter be described. Polarized waves V and H, which are collected at horn unit 3, propagate through waveguide element 2*a* in circular waveguide unit 2, and are reflected at reflection wall 2*b*. Vertically-polarized wave V reflected at reflection wall 2*b* is received by feed probe 10, transmitted to a microstrip line of circuit board 12, amplified and frequency-converted at a high-frequency circuit in a subsequent stage, into an intermediate frequency signal, and transmitted to the tuner via output terminal 15.

Furthermore, horizontally-polarized wave H reflected at reflection wall 2*b* is received by feed probe 11, transmitted to a microstrip line of circuit board 13, amplified at a high-frequency circuit in a subsequent stage, transmitted to circuit board 12 via connection probe 14, frequency-converted into an intermediate frequency signal, and transmitted to the tuner via output terminal 15.

In the first embodiment, vertically-polarized wave V and horizontally-polarized wave H are transmitted to separate circuit boards 12 and 13, respectively, and hence contact between the septum of the metal frame and the ground plane of the circuit board does no longer affect a cross polarization characteristic, as in the conventional case. Furthermore, board holding units 4 and 5 that hold circuit boards 12 and 13 are provided on the upside and the downside of chassis 1, respectively, so that there is no need to use a sliding insert in the design of a die. It is therefore possible to easily fabricate the die at low cost, and lower the price of the radio wave receiving converter.

Note that, although the first embodiment uses circular waveguide unit 2 having waveguide element 2*a* with a circular cross-sectional shape, it may of course be possible to use a rectangular waveguide unit having a waveguide element with a square cross-sectional shape.

Second Embodiment

Figure 3:
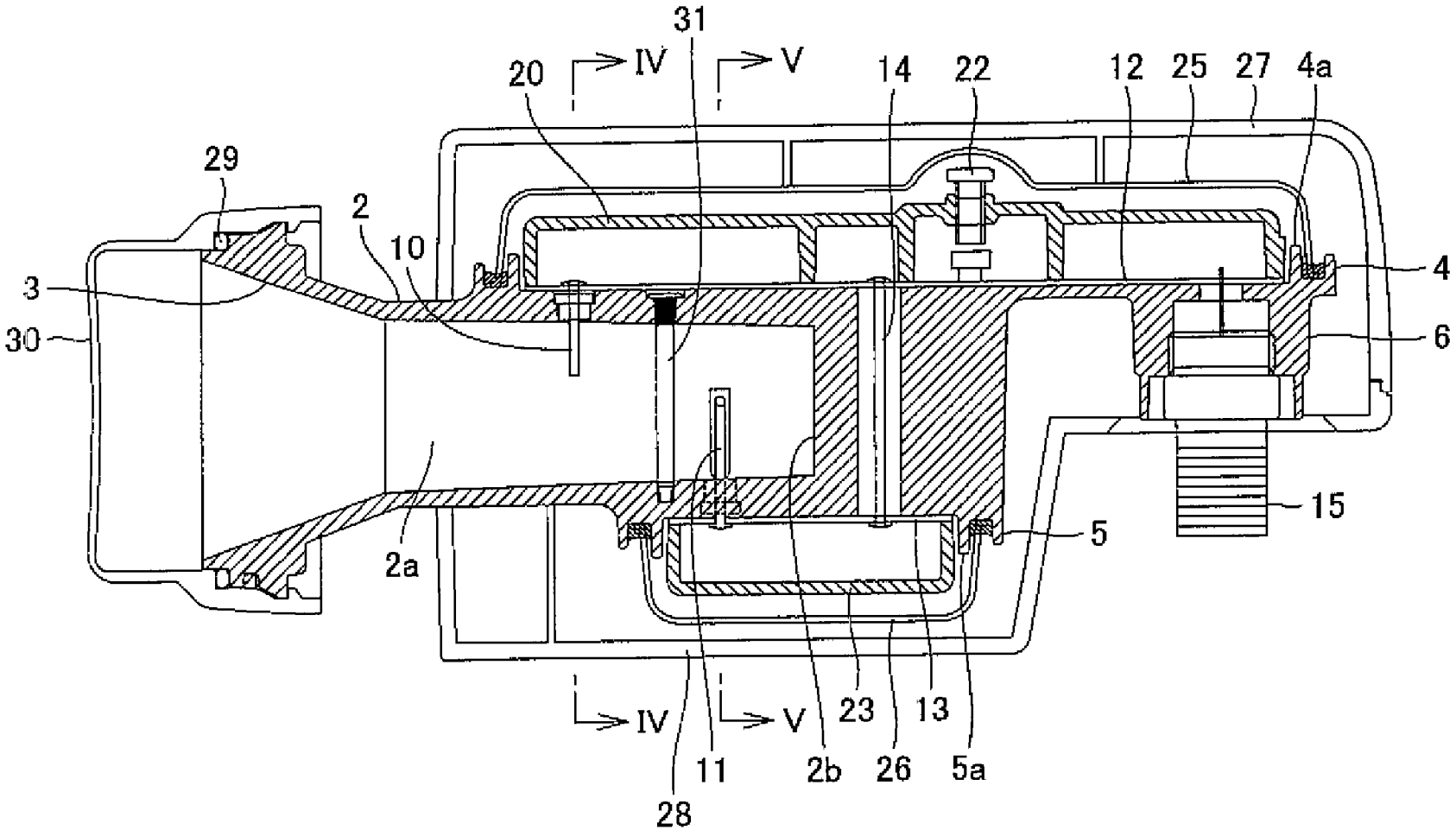
FIG. 3 is a cross-sectional view showing a configuration of a radio wave receiving converter according to a second embodiment of the present invention.
Figure 4:
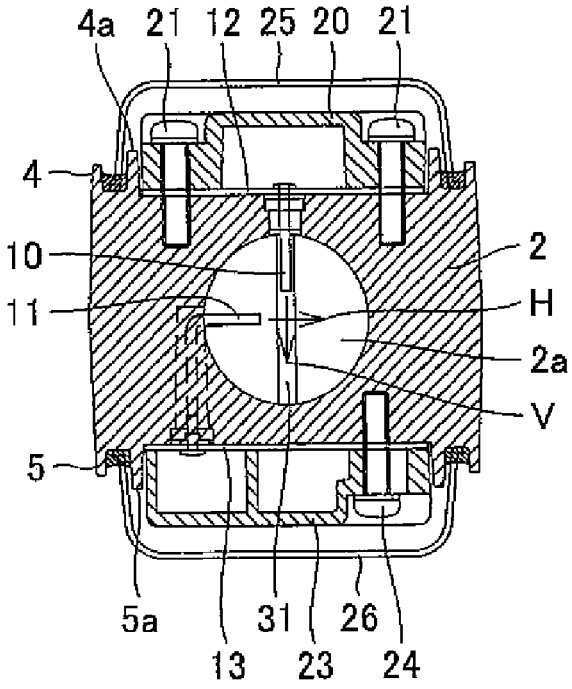
FIG. 4 is a cross-sectional view taken along a line IV-IV in FIG. 3.
Figure 5:
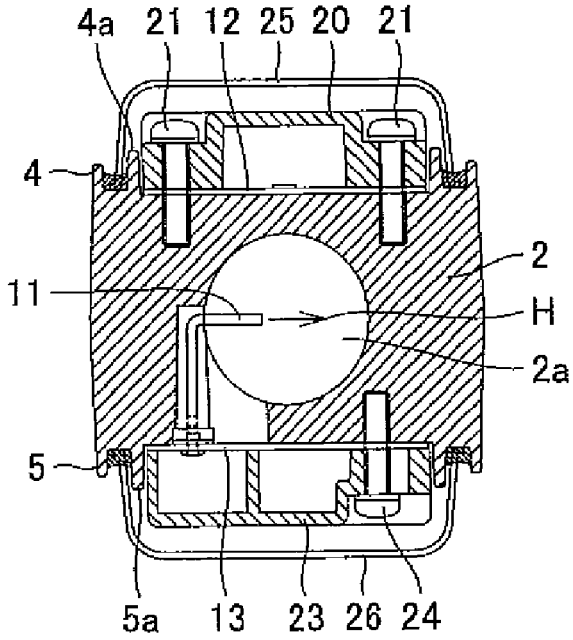
FIG. 5 is a cross-sectional view taken along a line V-V in FIG. 3.

FIG. 3 is a cross-sectional view showing a configuration of a radio wave receiving converter according to a second embodiment of the present invention. FIG. 4 is a cross-sectional view taken along a line IV-IV in FIG. 3, while FIG. 5 is a cross-sectional view taken along a line V-V in FIG. 3. In FIGS. 3-5, this radio wave receiving converter differs from the radio wave receiving converter according to the first embodiment in that a reflection rod 31 for reflecting vertically-polarized wave V is provided in circular waveguide unit 2 on a side of the opening with respect to feed probe 11, and that feed probe 10 is provided on the side of the opening with respect to reflection rod 31 by a prescribed distance (a quarter of wavelength $\lambda$ of vertically-polarized wave V). Reflection rod 31 is vertically inserted into waveguide element 2*a* via a through hole formed in an upper inner wall of waveguide element 2*a* and provided in a direction parallel with vertically-polarized wave V, with its tip fitted into a hole formed in a lower inner wall of waveguide element 2*a*, and its proximal end adhered to the through hole.

An operation of the radio wave receiving converter will hereinafter be described. Polarized waves V and H, which are collected at horn unit 3, propagate through waveguide element 2*a* in circular waveguide unit 2, and are reflected at reflection rod 31 and reflection wall 2*b*, respectively. Vertically-polarized wave V reflected at reflection rod 31 is received by feed probe 10, transmitted to the microstrip line of circuit board 12, amplified and frequency-converted at the high-frequency circuit in the subsequent stage, into an intermediate frequency signal, and transmitted to the tuner via output terminal 15.

Furthermore, horizontally-polarized wave H reflected at reflection wall 2*b* is received by feed probe 11, transmitted to the microstrip line of circuit board 13, amplified at the high-frequency circuit in the subsequent stage, transmitted to circuit board 12 via connection probe 14, frequency-converted into an intermediate frequency signal, and transmitted to the tuner via output terminal 15.

The second embodiment produces the same effects as those of the first embodiment. Furthermore, the reflection units intended for polarized waves V and H are provided separately, so that a band characteristic of a cross polarization characteristic inside circular waveguide unit 2 is expanded, which is advantageous for receiving broadband satellite broadcasting. In recent years, multichannel and broadband satellite broadcasting has been adopted, so that the radio wave receiving converter in the present embodiment has increasingly been used.

Third Embodiment

Figure 6:
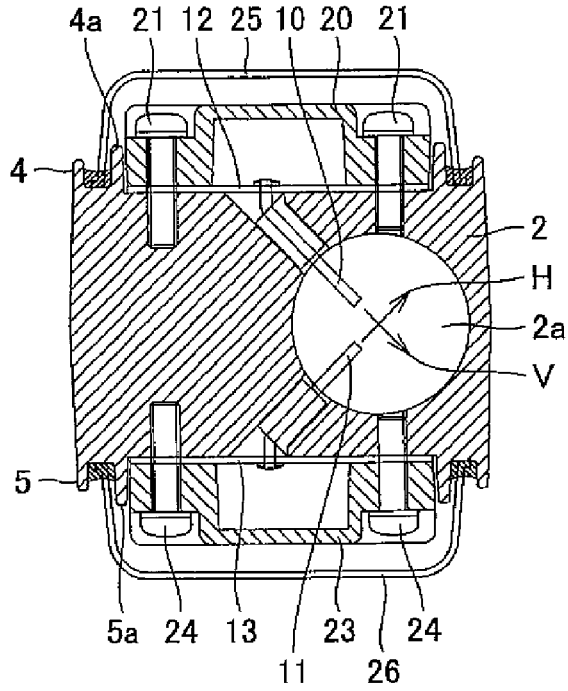
FIG. 6 is a cross-sectional view showing a configuration of a radio wave receiving converter according to a third embodiment of the present invention.

FIG. 6 is a cross-sectional view showing a configuration of a radio wave receiving converter according to a third embodiment of the present invention, and is to be compared with FIG. 2. In FIG. 6, the radio wave receiving converter differs from the radio wave receiving converter according to the first embodiment in that both of feed probes 10 and 11 are bent at 45 degrees.

The tip portion of feed probe 10 is fixed to a through hole formed on an obliquely upside of waveguide element 2*a* with an insulating member interposed therebetween, and protrudes in waveguide element 2*a* in a direction parallel with vertically-polarized wave V. The proximal end portion of feed probe 10 vertically penetrates circuit board 12 and is connected to the circuit provided at the surface of circuit board 12.

Similarly, the tip portion of feed probe 11 is fixed to a through hole formed on an obliquely downside of waveguide element 2*a* with an insulating member interposed therebetween, and protrudes in waveguide element 2*a* in a direction parallel with horizontally-polarized wave H. The proximal end portion of feed probe 11 vertically penetrates circuit board 13 and is connected to the circuit provided at the surface of circuit board 13. Other configurations and the operation thereof are the same as those of the radio wave receiving converter according to the first embodiment, and hence the description thereof will not be repeated.

The third embodiment also produces the same effects as those of the first embodiment. Furthermore, feed probes 10 and 11 can be made into the same shape, so that the number of types of parts can be reduced, and that differences in reception level between polarized waves V and H can be reduced.

Fourth Embodiment

Figure 7:
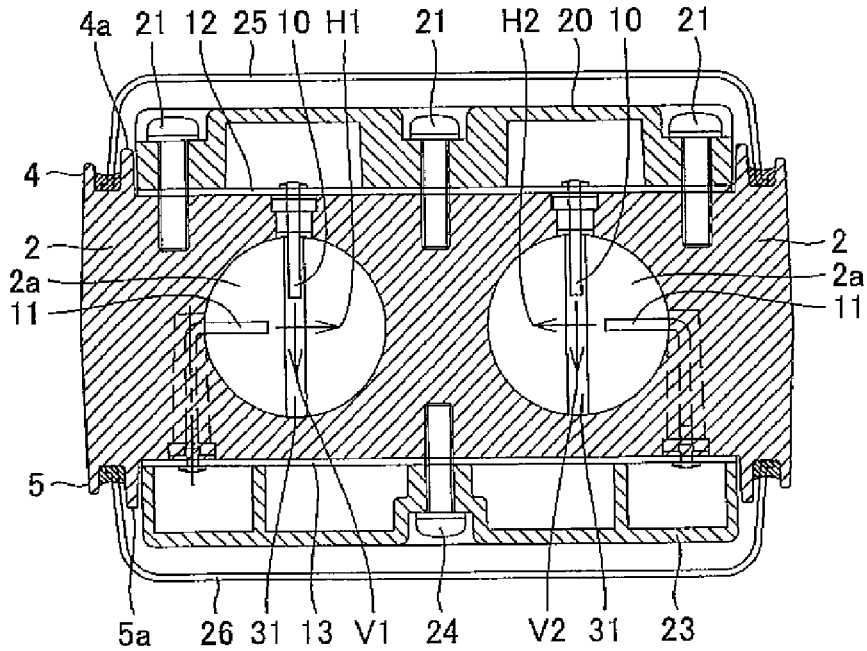
FIG. 7 is a cross-sectional view showing a configuration of a radio wave receiving converter according to a fourth embodiment of the present invention.

FIG. 7 is a cross-sectional view showing a configuration of a radio wave receiving converter according to a fourth embodiment of the present invention, and is to be compared with FIG. 4. In FIG. 7, the radio wave receiving converter differs from the radio wave receiving converter according to the second embodiment in that two circular waveguide units are provided. Two circular waveguide units 2 are arranged in parallel with each other at a prescribed spacing in a horizontal direction, and formed integrally. Each of circular waveguide units 2 is provided with feed probes 10 and 11. The proximal end portions of two feed probes 11 are provided to sandwich two waveguide elements 2*a*, and both of their tip portions are oriented inwardly. Board holding units 4 and 5, circuit boards 12 and 13, metal frames 20 and 23, and lids 25 and 26 are provided in a manner common to two circular waveguide units 2.

The fourth embodiment also produces the same effects as those of the first embodiment. Furthermore, it is possible to receive vertically-polarized waves V1, V2 and horizontally-polarized wave H1, H2 from two adjacent satellites. Furthermore, two feed probes 11 are provided at opposite sides of two waveguide elements 2*a*, so that a distance between two feed probes 11 can be made larger, and sufficient isolation between two feed probe 11 can be obtained.

Fifth Embodiment

Figure 8:
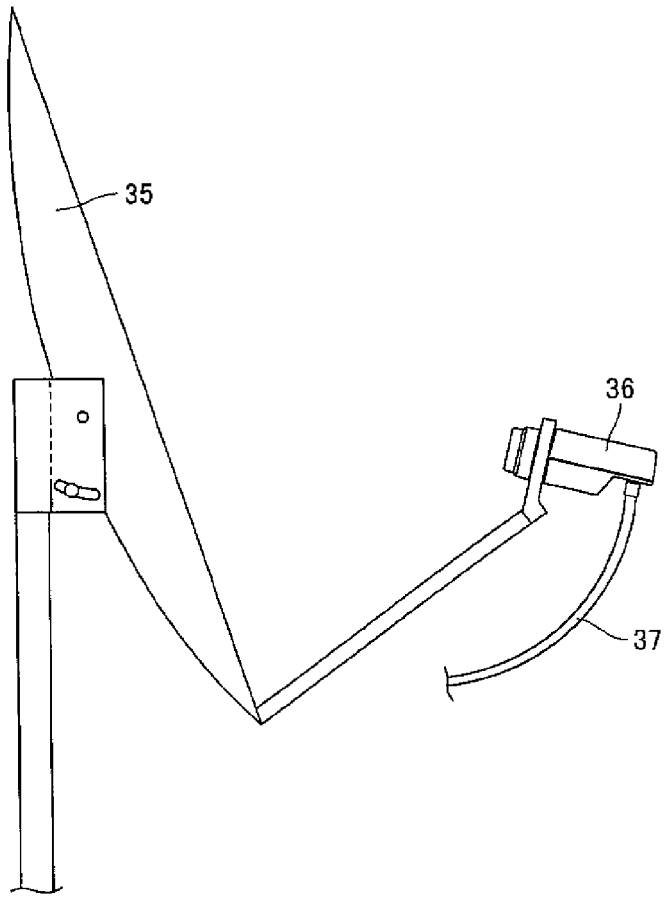
FIG. 8 is a drawing that shows a parabolic antenna according to a fifth embodiment of the present invention.
Figure 9:
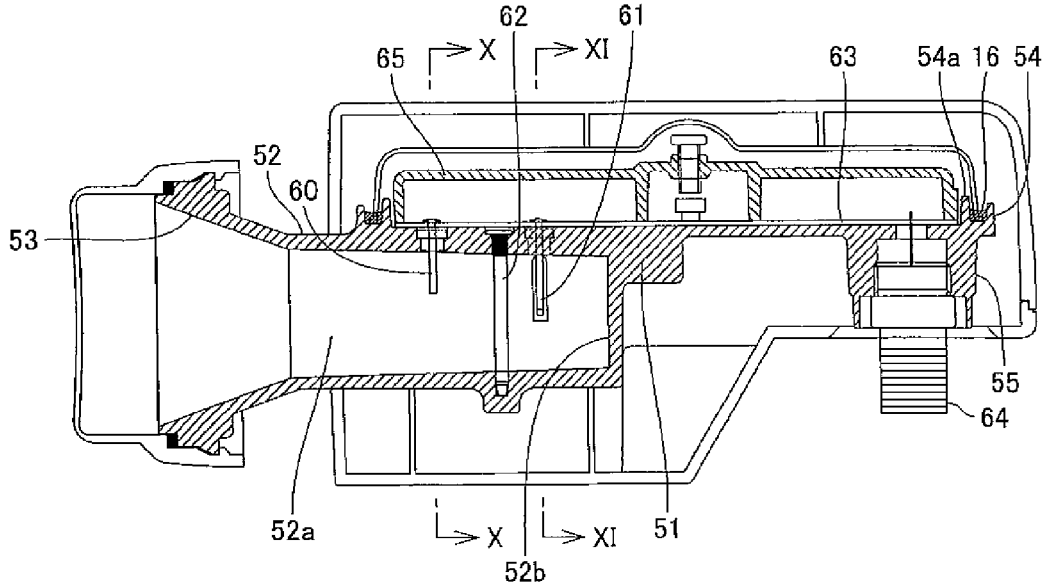
FIG. 9 PRIOR ART
FIG. 9 is a cross-sectional view showing a configuration of a conventional radio wave receiving converter.
Figure 10:
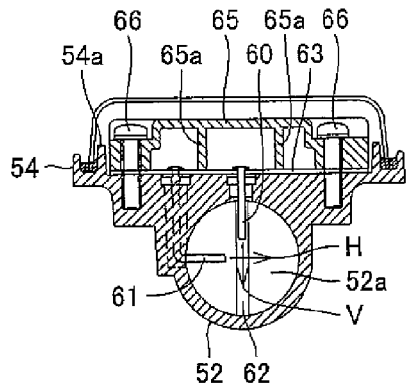
FIG. 10 PRIOR ART
FIG. 10 is a cross-sectional view taken along a line X-X in FIG. 9.
Figure 11:
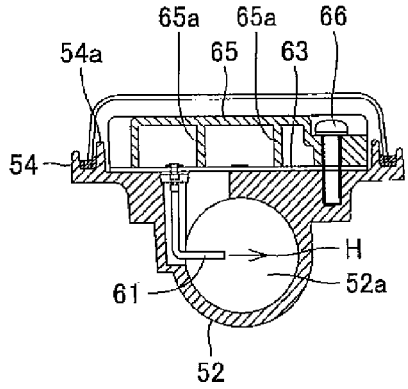
FIG. 11 PRIOR ART
FIG. 11 is a cross-sectional view taken along a line XI-XI in FIG. 9.
Figure 12:
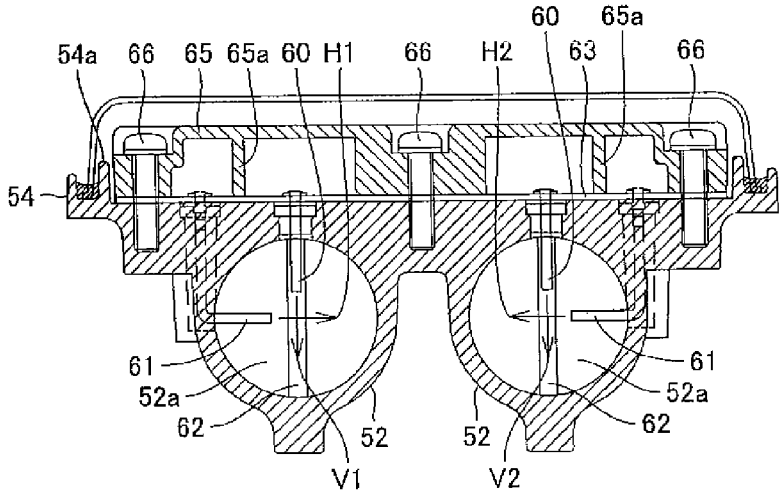
FIG. 12 PRIOR ART
FIG. 12 is a cross-sectional view showing a configuration of another conventional radio wave receiving converter.
Figure 13:
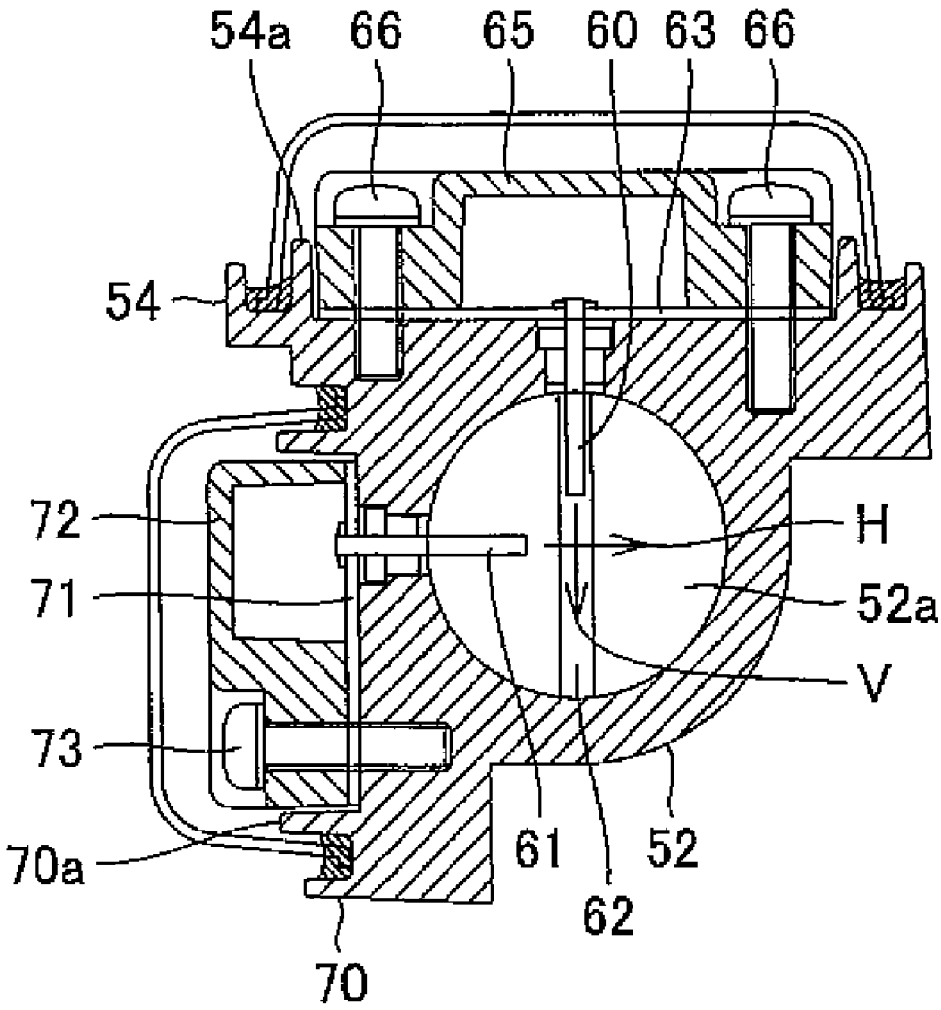
FIG. 13 PRIOR ART
FIG. 13 is a cross-sectional view showing a configuration of still another conventional radio wave receiving converter.

FIG. 8 is a drawing that shows a configuration of a parabolic antenna according to a fifth embodiment of the present invention. In FIG. 8, the parabolic antenna is provided with a parabolic reflecting mirror 35 and a radio wave receiving converter 36. Radio wave receiving converter 36, which is any of the radio wave receiving converters according to first to fourth embodiments, is arranged at a focus of parabolic reflecting mirror 35. Its output terminal 15 is connected to a receiver (not shown) or a television tuner (not shown) via a coaxial cable 37.

A radio wave transmitted from a satellite is collected at parabolic reflecting mirror 35 and made incident upon circular waveguide unit 2 of radio wave receiving converter 36, amplified and frequency-converted into an intermediate frequency signal, and provided to the receiver (not shown) or the television tuner (not shown) via coaxial cable 37. The fifth embodiment also produces the same effects as those of the first embodiment.

Although the present invention has been described and illustrated in detail, it is clearly understood that the same is by way of illustration and example only and is not to be taken by way of limitation, the scope of the present invention being interpreted by the terms of the appended claims.

What is claimed is:

1. An input device of a two orthogonal polarized-wave waveguide type, comprising:

a waveguide to which first and second polarized waves orthogonal to each other are input;

first and second board holding units for holding first and second circuit boards, respectively; and first and second probes having tip portions provided to protrude in said waveguide in parallel with said first and second polarized waves, respectively, and having proximal end portions connected to said first and second circuit boards, respectively, wherein said waveguide and said first and second board holding units are integrally formed, and said first board holding unit is provided on a first side of said waveguide, and said second board holding unit is provided on a second side of said waveguide, said second side of said waveguide being at a side opposing said first side of said waveguide, such that said waveguide is sandwiched between said first board holding unit and said second board holding unit.

2. The input device of the two orthogonal polarized-wave waveguide type according to claim 1, wherein said first probe is approximately vertically provided at said first circuit board, and said second probe is bent at approximately a right angle, and the proximal end portion of said second probe is approximately vertically provided at said second circuit board.

3. The input device of the two orthogonal polarized-wave waveguide type according to claim 2, wherein two of the waveguides, one set of said first and second board holding units, and two sets of said first and second probes are provided, the two of said waveguides and said first and second board holding units are formed integrally, the two of said waveguides are arranged in parallel at a prescribed spacing, said first board holding unit is provided on a first side of the two of said waveguides, and said second board holding unit is provided on a second side of the two of said waveguides, the second side of the two of said waveguides being at a side opposing said first side of the two of said waveguides, such that the two of said waveguides are sandwiched between said first board holding unit and said second board holding unit, and a distance between two of said second probes is larger than a distance between two of said first probes.

4. The input device of the two orthogonal polarized-wave waveguide type according to claim 1, wherein both of said first and second probes extend at approximately 45 degrees, and the proximal end portions of said first and second probes are bent in approximately vertical direction and connected to said first and second circuit boards, respectively.

5. The input device of the two orthogonal polarized-wave waveguide type according to claim 1, wherein one end of said waveguide is opened for introducing said first and second polarized waves, the other end of said waveguide is closed by a reflection wall, a reflection rod reflecting said first polarized wave is provided in said waveguide in parallel with said first polarized wave, said first probe is provided on a side of the one end of said waveguide, with respect to said reflection rod, said second probe is provided between said reflection rod and said reflection wall, said first probe receives said first polarized wave reflected at said reflection rod, and said second probe receives said second polarized wave reflected at said reflection wall.

6. The input device of the two orthogonal polarized-wave waveguide type according to claim 1, wherein said waveguide is a circular waveguide having a waveguide element with a circular cross-sectional shape.

7. The input device of the two orthogonal polarized-wave waveguide type according to claim 1, wherein said waveguide is a rectangular waveguide having a waveguide element with a rectangular cross-sectional shape.

8. The input device of the two orthogonal polarized-wave waveguide type according to claim 1, wherein a plurality of the waveguides, one set of said first and second board holding units, and a plurality of sets of said first and second probes are provided, the plurality of said waveguides and the one set of said first and second board holding units are integrally formed, the plurality of said waveguides are arranged in parallel at a prescribed spacing, and said first board holding unit is provided on a first side of the plurality of said waveguides, and said second board holding unit is provided on a second side of the plurality of said waveguides, said second side of the plurality of said waveguides being at a side opposing said first side of the plurality of said waveguides, such that the plurality of said waveguides is sandwiched between said first board holding unit and said second board holding unit.

9. A radio wave receiving converter, comprising:

the input device of the two orthogonal polarized-wave waveguide type recited in claim 1; and the first and second circuit boards held by said first and second board holding units, respectively; wherein a conversion circuit amplifying and frequency-converting said first and second polarized waves received at said first and second probes is arranged dividedly at said first and second circuit boards.

10. An antenna device, comprising:

the radio wave receiving converter recited in claim 9; and a reflection unit receiving said first and second polarized waves transmitted from a satellite, and reflecting said first and second polarized waves to said waveguide.

11. The input device of the two orthogonal polarized-wave waveguide type according to claim 1, wherein said first board holding unit and said second board holding unit of said waveguide are provided horizontally with respect to said waveguide.

* * * * *